United States Patent [19]

Kronich

[11] Patent Number: 4,671,057

[45] Date of Patent: Jun. 9, 1987

[54] STAMPED EXHAUST MANIFOLD INCLUDING A BAFFLE FOR FORMING AN INSULATED CHAMBER

[75] Inventor: Peter G. Kronich, Sheboygan, Wis.

[73] Assignee: Tecumseh Products Company, Tecumseh, Mich.

[21] Appl. No.: 759,644

[22] Filed: Jul. 26, 1985

[51] Int. Cl.[4] ..... F01N 7/08

[52] U.S. Cl. ..... 60/272; 60/323; 181/240

[58] Field of Search ..... 60/282, 322, 323, 272; 181/240

[56] References Cited

U.S. PATENT DOCUMENTS

| | | | |
|---|---|---|---|
| 1,044,181 | 11/1912 | Hudson . | |
| 2,255,807 | 1/1940 | Towler . | |
| 3,043,094 | 2/1960 | Nichols . | |
| 3,413,803 | 2/1968 | Rosenlund et al. . | |
| 3,541,785 | 11/1970 | Wahnschaffe et al. . | |
| 3,703,083 | 11/1972 | Tadokoro . | |
| 3,940,927 | 3/1976 | Maurhoff et al. . | |
| 3,958,418 | 5/1976 | Heidacker | 60/323 |
| 4,106,288 | 8/1978 | Nagaishi | 60/323 |
| 4,356,885 | 11/1982 | Dello . | |
| 4,373,331 | 2/1983 | Santiago | 60/323 |

*Primary Examiner*—Douglas Hart

*Attorney, Agent, or Firm*—Jeffers, Irish & Hoffman

[57] ABSTRACT

A stamped exhaust manifold for a small internal combustion engine having a stamped sheet metal housing including an inlet and an outlet. A sheet metal baffle is located in the housing opposite the inlet and spaced from the housing to form a dead air insulating pocket between the baffle and the housing. The baffle is positioned so that hot exhaust gas entering the manifold from the engine through the inlet port will impinge directly on the baffle and will be deflected thereby through substantially 90° to the manifold outlet port.

11 Claims, 8 Drawing Figures

STAMPED EXHAUST MANIFOLD INCLUDING A BAFFLE FOR FORMING AN INSULATED CHAMBER

BACKGROUND OF THE INVENTION

This invention pertains to manifolds for internal combustion engines and more specifically to stamped manifolds for small internal combustion engines.

With the development of the vertical and horizontal shaft overhead valve type of engine, the exhaust port in the cylinder head is oriented so that, in certain applications, an exhaust manifold is required between the muffler and the cylinder head exhaust port. In such applications the manifold, besides providing a conduit between the exhaust port and the muffler, changes the direction of flow of the exhaust gas. Certain surfaces of the exhaust muffler are therefore exposed to direct impingement of the hot exhaust gases which exit from the engine exhaust port. Such manifolds must therefore be able to withstand the high temperatures of the exhaust gas, which temperatures may be in the range of 1,100° F. to 1,300° F.

The majority of exhaust manifolds used on prior art small single cylinder engines have been manufactured from cast iron. Such manifolds, after casting, must be machined to accomodate the exhaust port mounting bolts for securing the manifolds to the engine and to the muffler. Such manifolds are therefore relatively expensive both because of the cost of materials and the cost of machining the manifolds. Furthermore, such cast manifolds are relatively heavy and bulky requiring more space than a stamped manifold and therefore add undesired weight to the engine which is especially undesirable in small engines.

In some prior art engines stamped exhaust manifolds have been used. However, such stamped exhaust manifolds have been manufactured from stainless steel or other exotic high temperature resistant metals since cold rolled draw quality steel would not be resistant to the high temperatures encountered in such manifolds. While such stainless steel stamped manifolds are resistant to flame burn-through, such manifolds are also relatively expensive because of the cost of the metals involved and are furthermore difficult to manufacture because stainless steel tends to work harden in deep draw stamping operations. The stamping process therefore requires annealing steps between drawing operations thus adding further manufacturing cost. Lastly, the welding process for welding the several parts of such stainless steel manifolds together is a difficult and expensive operation.

It is therefore desired to provide a stamped exhaust manifold for an internal combustion engine which may be manufactured from relatively inexpensive draw quality sheet metal which can be formed into an effective, inexpensive manifold which is not subject to flame burn-through.

SUMMARY OF THE INVENTION

The present invention, overcomes the disadvantages of the above described prior art exhaust manifolds by providing an improved exhaust manifold therefor. The manifold of the present invention comprises a stamped, sheet metal housing and includes a baffle located in the housing and spaced apart therefrom to form a dead air insulating pocket between the baffle and the housing. The baffle is positioned so that the hot exhaust gas entering the manifold inlet port from the exhaust port of the engine cylinder will impinge directly on the baffle and will be deflected thereby toward the manifold outlet port and the muffler.

The exhaust manifold of the present invention, in one form thereof, further comprises a housing shell including upper and lower shell halves formed of stamped sheet metal and sealingly secured together by means of a crimped seam. The upper shell half includes an inlet port whose axis is oriented at right angles with respect to the axis of the manifold outlet port. A baffle is secured to the lower shell half inside the housing and opposite the inlet port, whereby engine exhaust gas entering the manifold impinges upon the baffle. The baffle is spaced from the lower shell to form a dead air pocket between the shell and the baffle for insulating the housing lower shell half from the hot entering exhaust gas. The baffle deflects the hot gas and directs it toward the outlet port.

An advantage of the manifold construction according to the present invention is that, since the baffle insulates the manifold housing by means of the dead air pocket from direct impingement of the hot exhaust gas on the housing, the manifold housing may be constructed of inexpensive cold rolled draw quality steel. The cost of this material is much lower than the cost of the exotic temperature resistant metals used in prior art stamped exhaust manifolds. Furthermore the cost of manufacturing cold rolled draw quality steel into a stamped manifold is also much lower since this material is much easier to stamp in deep draw operations.

Another advantage of the stamped exhaust manifold according to the present invention is that the weight and size of the manifold is much less than that of the prior art cast iron types of exhaust manifolds. This is especially important in small engines where weight and component size must be kept to a minimum.

A further advantage of a stamped sheet metal exhaust manifold according to the present invention is that flame burn-through of the manifold is prevented and the life of the manifold is extended by having the hot exhaust gases impinge directly on the baffle rather than the housing and by providing an insulated dead air chamber between the manifold housing and the baffle.

Still another advantage of the manifold according to the present invention is that the temperature of the manifold housing will be lower than the housing temperatures of prior art exhaust manifolds.

The invention, in a preferred embodiment, comprises an exhaust manifold for an internal combustion engine having a shell housing including upper and lower shell halves. The shell halves are sealingly secured together to form a chamber. An inlet port is located in the upper shell half for the entry of exhaust gas into the manifold and an outlet port is located in the housing, remote from the inlet port, for the discharge of exhaust gas from the manifold. The axis of the outlet port is oriented at substantially 90° with respect to the axis of the inlet port. A baffle is disposed in the chamber opposite the inlet port for impingement thereupon of the exhaust gas entering the inlet port. The baffle is adapted to deflect the entering exhaust gas and to direct the gas toward the manifold exhaust port. The baffle is secured to the lower shell half and is spaced therefrom to form a dead air pocket with the lower shell half for insulating the housing from the hot exhaust gas entering the manifold inlet port.

It is an object of the present invention to provide a stamped sheet metal manifold manufactured from draw quality cold rolled steel and including a baffle for the impingement of hot exhaust gas thereupon whereby the manifold housing is insulated and flame burn-through is prevented.

It is another object of the present invention to provide a stamped sheet metal exhaust manifold wherein the weight and size of the manifold is much less than the weight of the prior art cast iron types of manifolds.

It is a still further object of the present invention to provide a stamped sheet metal exhaust manifold wherein the temperature of the housing is lower than the housing temperatures of prior art exhaust manifolds.

A yet further object of the present invention is to provide a stamped sheet metal manifold wherein the exhaust gas is deflected at substantially 90° from the manifold inlet port to the manifold outlet port.

BRIEF DESCRIPTION OF THE DRAWINGS

The above mentioned and other features and objects of the invention and the manner of obtaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
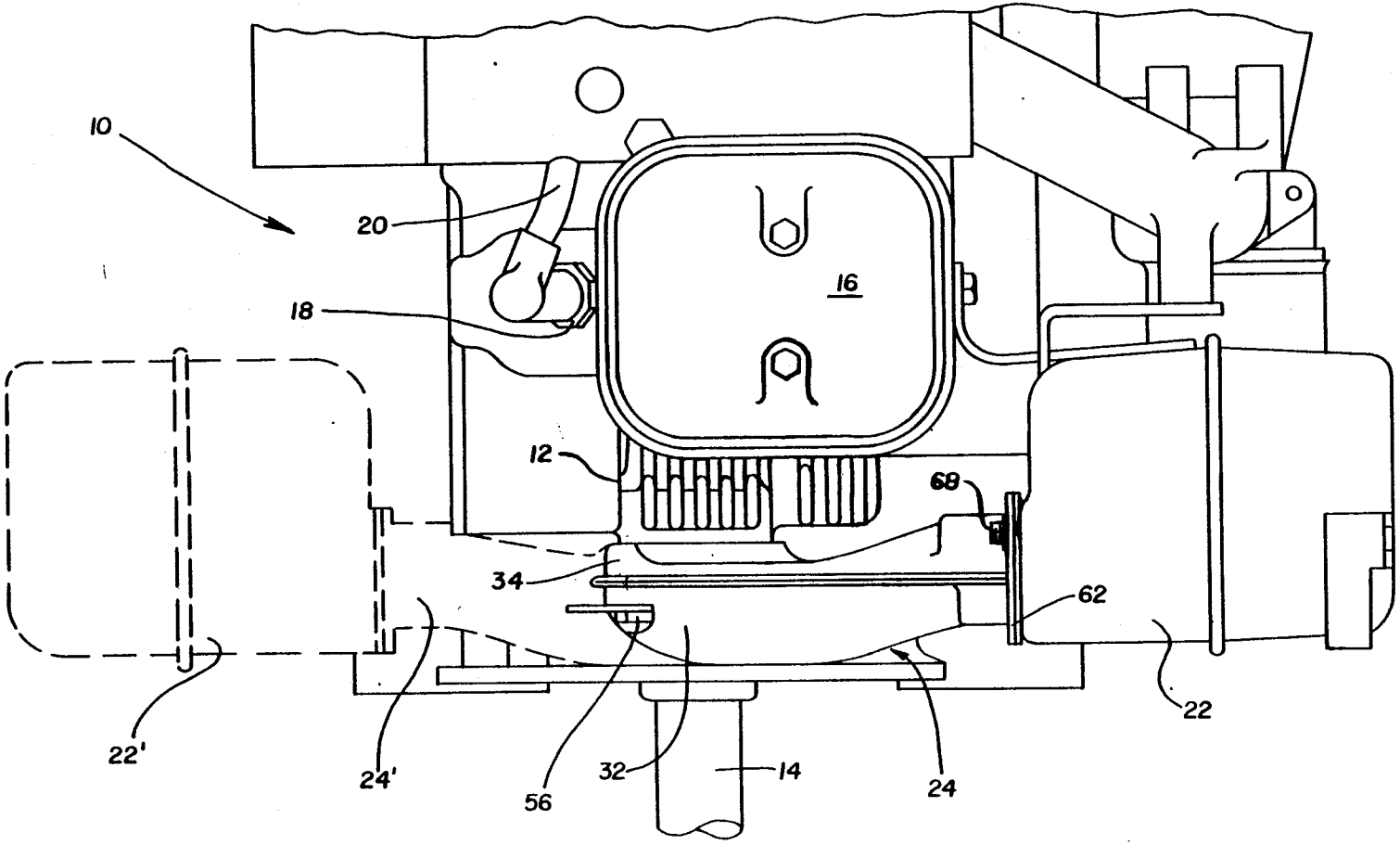
FIG. 1 is a plan view of an engine incorporating a preferred embodiment of the stamped baffled exhaust manifold of the present invention.

Referring to FIG. 1 a single cylinder engine 10 is shown including cylinder block 12, crankshaft 14, valve cover 16 and spark plug 18. Spark plug wire 20 supplies electrical ignition pulses to spark plug 18. Muffler 22 is shown at the lower right hand side of the engine connected to an exhaust manifold 24. The position of manifold 24 and muffler 22 may be reversed with respect to the engine as shown in the dotted line representations with manifold 24' and muffler 22' located toward the left of engine 10.

Figure 4:
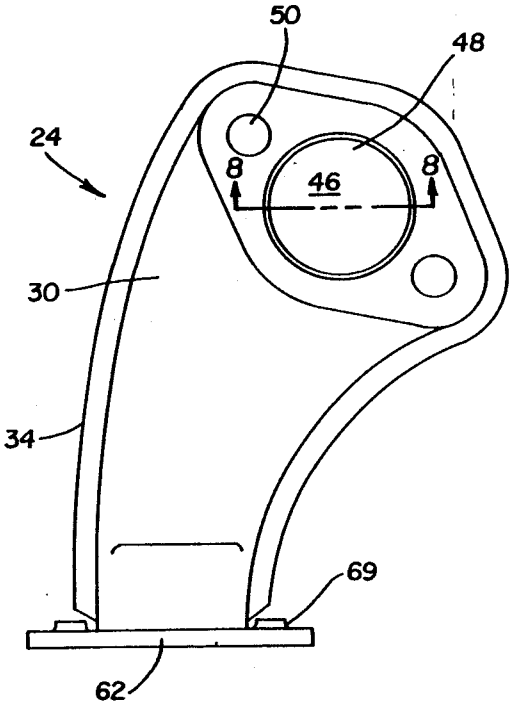
FIG. 4 is a side elevational view of the manifold taken from the right side of FIG. 2.
Figure 2:
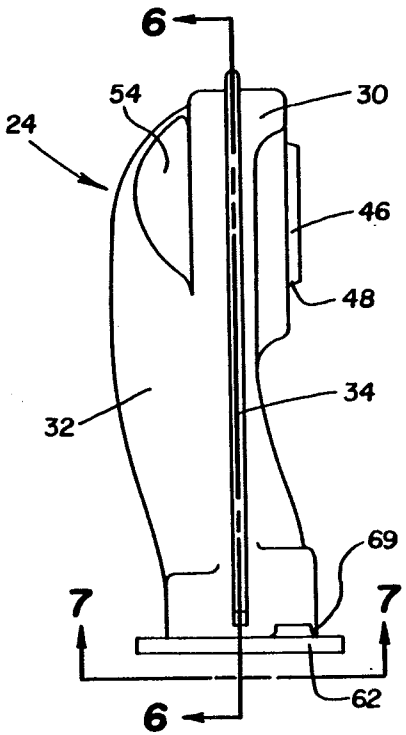
FIG. 2 is a front elevational view of the manifold of the present invention.
Figure 3:
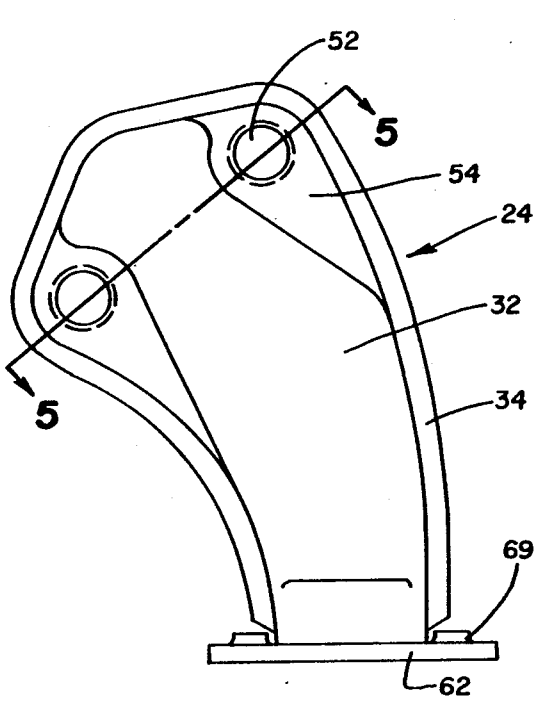
FIG. 3 is a side elevational view of the manifold taken from the left side of FIG. 2.

Referring now to FIGS. 2-4, manifold 24 comprises a shell housing including an upper shell half 30 and a lower shell half 32 which are secured and sealed together by means of a crimp seam 34 to form a chamber 35. The seal provided by crimp seam 34 between upper shell half 30 and lower shell half 32 insures that exhaust gas passing manifold 24 will exit through the manifold outlet port 60. Seam 34, as best seen in FIG. 5, comprises a flanged portion 36 of lower shell half 32 which is crimped around a flanged portion 38 of upper shell 30.

Referring further to FIGS. 1-4 and 8, a manifold inlet port 46 is provided in the lower shell of manifold 24 including an upstanding flanged portion 48. Flange 48 is disposed inside an engine exhaust port (not shown) in the cylinder block of engine 10 and manifold 24 is secured to the cylinder block 12 by means of two bolts 56. Bolts 56 are disposed in mounting holes 50 in upper shell 30 and which are aligned with mounting holes 52 in lower shell 32 of the manifold. In the preferred embodiment two bolts 56 are provided for securing the manifold 24 to the cylinder block 12 although more or fewer such bolts and mounting holes may be provided. As best seen in FIGS. 2, 3 and 5 relieved portions 54 are provided in lower shell 32 for accomodating mounting holes 52 and fasteners 56.

Figure 7:
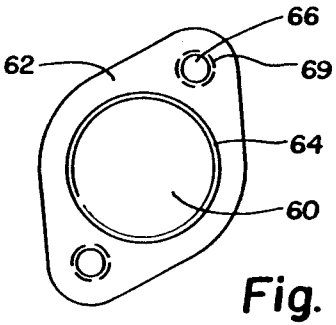
FIG. 7 is a view of the muffler attachment flange of the manifold taken along line 7—7 of FIG. 2.

Turning now to FIGS. 2 and 7 an outlet port 60 is provided in manifold 24, which port comprises an aperture in muffler mounting flange 62. Mounting flange 62 is welded to upper and lower shell halves 30 and 32, respectively, at 64. Muffler mounting flange 62 is secured to muffler 22 by means of two bolts 68 which are disposed in mounting holes 66 in muffler mounting flange 62. Mounting holes 66 each include an upstanding flange 69.

Figure 6:
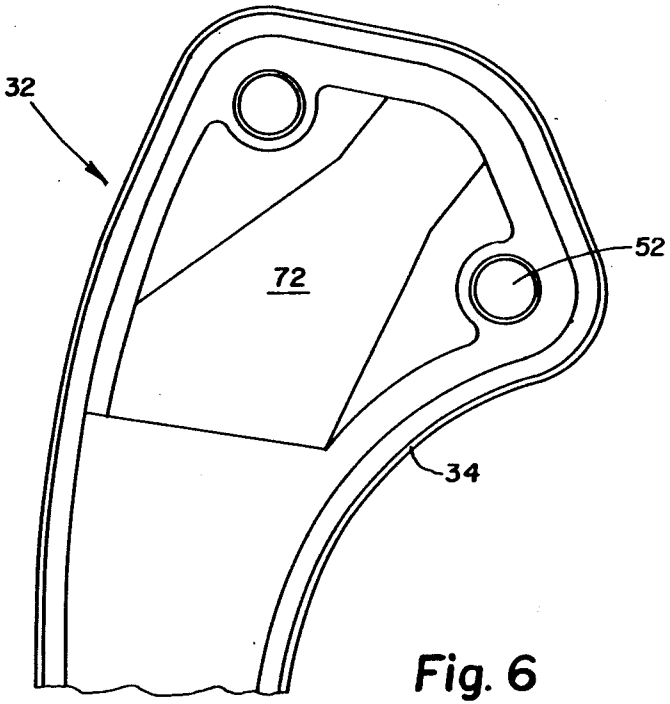
FIG. 6 is an enlarged sectional view of the manifold taken along line 6—6 of FIG. 2.
Figure 8:
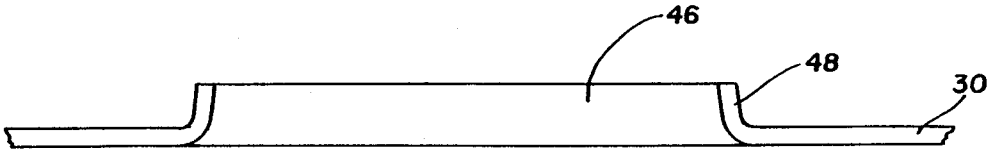
FIG. 8 is an enlarged sectional view of the manifold inlet port taken along line 8—8 of FIG. 4.
Figure 5:
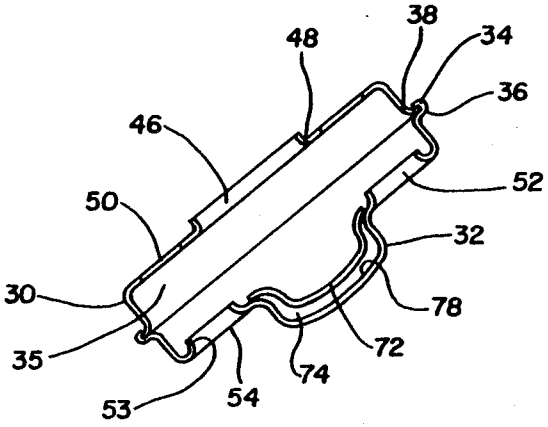
FIG. 5 is a sectional view of the manifold taken along line 5—5 of FIG. 3.

As best seen in FIGS. 5 and 6 a curved baffle or deflector 72 is disposed inside chamber 35 opposite inlet port 46. Baffle 72 is secured to lower housing shell 32 by means of spot welding or any other suitable means and is spaced apart from the inner wall of lower shell half 32 to form a dead air pocket 74 or chamber therewith. In the preferred embodiment the depth of space 74 between baffle 72 and inner wall 78 is in the range of 3/16 inch to 5/16 inch. Dead air space 74 provides insulation for the manifold housing so that hot exhaust gas entering manifold inlet port 46 from the exhaust port of the engine cylinder will impinge directly on baffle 72 rather than on inner wall 78 of lower shell half 32. Baffle 72 is curved in order to deflect the entering hot gas in a smooth continuous fashion from inlet port 46 to outlet port 60 through an angle of substantially 90°. The temperature of the exhaust gas may be in the range of 1,100° to 1300° F., whereby baffle 72 is heated to temperatures in that range during operation of the engine. Applicant has found that the temperature of the exhaust manifold housing will be as much as 180° F. cooler than the temperature of the adjacent baffle 72 due to the insulation provided by space 74. As the exhaust gas passes from inlet port 46 of manifold 24 to outlet port 60 the temperature of the exhaust gas will decrease as heat is given up to the exhaust manifold. The temperature of baffle 72 will be highest at the point where the exhaust gas impinges directly on baffle 72 from inlet port 46.

The entire manifold 24, including baffle 72, upper shell half 30 and lower shell half 32 are preferably constructed of common draw quality cold rolled steel stock which is easily manufactured into the desired shape since it has good drawing qualities. Muffler mounting flange 62 may be formed of the same material and is preferably welded to upper and lower manifold shells 30 and 32. In the preferred embodiment baffle 72 is preferably spot welded to lower housing 32 to provide good contact therewith and to secure baffle 72 in place.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. An exhaust manifold for an internal combustion engine comprising:

a housing including upper and lower members, said members formed of sheet metal and sealingly secured together to form said housing, said housing adapted to be secured to an engine and to a muffler;

an inlet port in said upper member;

an outlet port in said housing, the axis of said outlet port oriented at substantially right angles to the axis of said inlet port;

a sheet metal baffle in said housing secured to said lower housing member opposite said inlet port whereby engine exhaust gas entering said manifold inlet port will impinge upon said baffle, said baffle being of a size to extend only across the region of the housing against which said exhaust gas impinges, said baffle spaced from said lower housing member to form an air pocket between said lower housing member and said baffle for insulating said lower housing member from said hot entering exhaust gas, whereby said baffle deflects entering gas and directs said gas to said outlet port.

2. The exhaust maifold of claim 1 wherein said housing and baffle are formed of cold rolled drawn steel.

3. The exhaust manifold of claim 1 wherein said air pocket has a depth of from 3/16 inches to 5/16 inches.

4. The exhaust manifold of claim 1 wherein said housing members are secured together with a crimped seam.

5. An exhaust manifold for an internal combustion engine comprising:

a shell housing having upper and lower shell halves, said shell halves sealingly secured together to form a chamber;

an inlet port in said upper shell half for the entry of exhaust gas into said manifold;

an outlet port in said housing remote from said inlet port, for the discharge of exhaust gas from said manifold, the axis of said outlet port oriented at substantially 90° with respect to the axis of said inlet port;

baffle means disposed in said chamber opposite said inlet port for impingement thereupon of the exhaust gas entering said inlet port, said baffle being of a size to extend only across the region of the housing against which said exhaust gas impinges, said baffle means adapted to deflect said entering gas and to direct toward said exhaust port, said baffle secured to said lower shell half and spaced therefrom to form a dead air pocket with said lower shell half for insulating said housing from said hot exhaust gas entering said inlet port.

6. The exhaust manifold of claim 5 wherein said gas is deflected by said baffle through substantially 90° .

7. The exhaust manifold of claim 5 wherein said housing and said baffle are formed of cold rolled draw quality steel.

8. The exhaust manifold of claim 5 wherein said dead air pocket has a depth of from 3/16 inches to 5/16 inches.

9. The exhaust manifold of claim 5 wherein said baffle means comprises a curved sheet metal member adapted to deflect said exhaust gases through substantially 90° as the gas traverses said manifold from said inlet port to said outlet port, said outlet port including a mounting flange for securing said manifold to said muffler.

10. The exhaust manifold of claim 5 wherein said housing shell halves are secured together with a crimped seam.

11. An exhaust manifold for an internal combustion engine comprising:

a housing;

an inlet port in said housing;

an outlet port in said housing;

a baffle in said housing, said baffle spaced from said housing to form a pocket between said baffle and said housing, said baffle positioned for direct impingement thereupon of exhaust gas entering said inlet port from the engine, said baffle covering only the gas impingement region of said housing, said pocket being a dead air pocket having a depth from 3/16 inches to 5/16 inches.

* * * * *